United States Patent [19]

Williams

[11] Patent Number: 4,780,913

[45] Date of Patent: Nov. 1, 1988

[54] TOILET SEAT VENTING APPARATUS

[76] Inventor: T. J. Williams, Rt. 4, Box 920, Hazelhurst, Ga. 31539

[21] Appl. No.: 747,334

[22] Filed: Jun. 21, 1985

Related U.S. Application Data

[63] Continuation-in-part of Ser. No. 611,823, May 18, 1984, abandoned.

[51] Int. Cl.[4] ..... E03D 9/04

[52] U.S. Cl. ..... 4/217; 4/213

[58] Field of Search ..... 4/217, 218, 209 R, 213, 4/214; 15/306 A, 307, 418, 419, 416; 98/41.3

[56] References Cited

U.S. PATENT DOCUMENTS

| | | | |
|---|---|---|---|
| 978,984 | 12/1910 | Burdick | 15/419 |
| 2,119,529 | 6/1938 | Dick | 4/217 |
| 2,728,088 | 12/1955 | Gudis | 4/217 |
| 3,416,167 | 12/1968 | Klemme | 4/217 |
| 3,849,808 | 11/1974 | Olson et al. | 4/213 |
| 3,916,459 | 11/1975 | Ivancevic | 4/217 |
| 4,103,370 | 8/1978 | Arnold | 4/217 |
| 4,174,545 | 11/1979 | Smith, Jr. | 4/213 |

*Primary Examiner*—Henry J. Recla
*Assistant Examiner*—Linda J. Sholl
*Attorney, Agent, or Firm*—Jones, Askew & Lunsford

[57] ABSTRACT

An improved toilet seat venting apparatus providing a pipe fitting fixedly secured to the rear rim of a conventional toilet. A portion of the pipe fitting is sectioned to provide a deflecting surface or formed to provide a plurality of openings. A toilet seat including a plurality of intake ports is pivotally mounted to the pipe fitting. The present invention provides a channel disposed within the toilet seat so as to communicate with said sectioned portion of said pipe fitting regardless of the position of said toilet seat. A baffle is provided within the channel for selectively obstructing same and a suction device is also provided for drawing gases into the intake ports and through the pipe fitting.

2 Claims, 7 Drawing Sheet

Fig_5
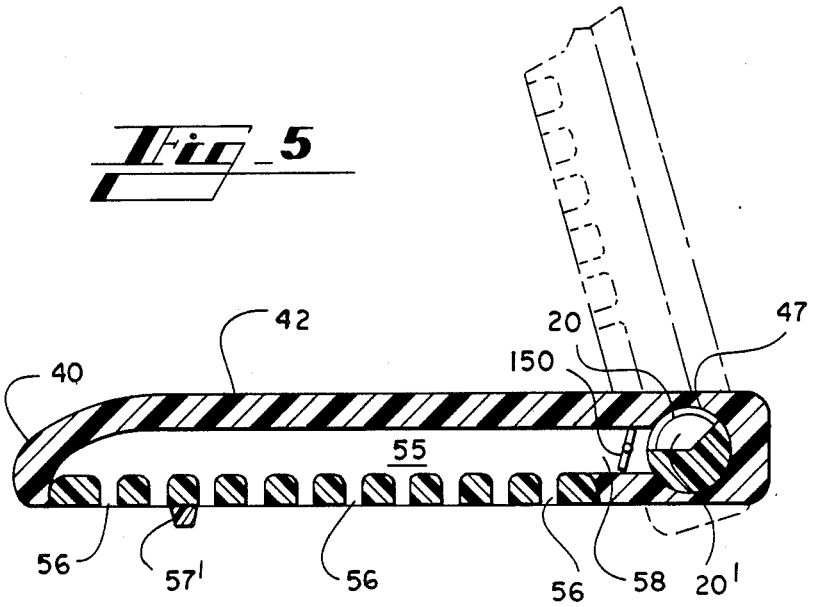
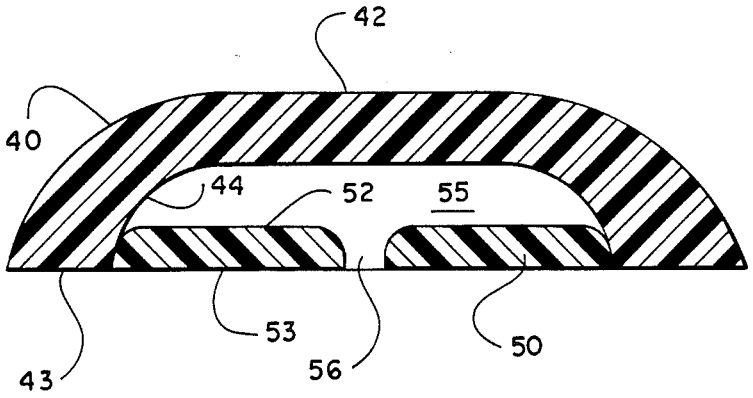
Fig_6

TOILET SEAT VENTING APPARATUS

CROSS-REFERENCE TO RELATED APPLICATION

This application is a continuation-in-part of Ser. No. 611,823, Filed May 18, 1984, now abandoned.

TECHNICAL FIELD

The present invention relates generally to venting offensive odors from a bathroom, and more particularly relates to an improved toilet seat venting apparatus.

BACKGROUND OF THE INVENTION

The need for venting a bathroom of offensive odors has been recognized for many years. As a result, various types of venting devices are known in the prior art purporting to fulfill this need. For example, exhaust fans have long been used as a bathroom venting device. Furthermore, as shown in U.S. Pat. Nos. 4,071,915; 4,085,470; and 4,175,293, venting devices have been provided for use with a conventional toilet.

Such prior art devices suffer from one or more of a number of disadvantages. For example, U.S. Pat. No. 4,175,293 teaches a single intake port positioned so as to withdraw gases from a toilet bowl. Such a device fails to recognize that offensive odors permeate a bathroom and is, therefore, largely ineffective as to such distributed ordors. As a further example, U.S. Pat. No. 4,071,915 shows a venting device in combination with a warm air seat warmer. The toilet seat of this device includes both a suction passageway and a warm air blowing passageway. Again, such a device is ineffective to remove odors that have permeated a bathroom. If the seat was pivoted away from the rim of the toilet bowl in an attempt to remove such odors, the result would simply be a swirling of air due to the combination of functions provided.

As a yet further example of the prior art, U.S. Pat. No. 4,085,470 discloses a venting pad adapted for engagement between the toilet bowl and seat. Such a device not only fails to consider the distribution of odors within a bathroom, but further fails to recognize the humid environment provided by most bathrooms. The device shown by this patent would easily mildew, thus detracting from the sanitary and aesthetic conditions traditionally desired in a bathroom.

A common problem with such prior art devices is that they provide an open port to the exterior of the building in which they are placed. As a result of differing temperatures between the inside and outside of the structure or as a result of wind gusts, drafts are often created. For example, in the winter, hot air from the house rises and is sucked out of the house through this open port. It is desirable to make the device compatible with the building so as to maintain heated or cooled conditions, whatever may be appropriate.

The inability to clean such prior art devices is another common problem. Due to their intended use, it is desirable to periodically clean all inner passageways. Otherwise, over a period of time, the venting device contributes to the problem of offensive odors rather than solving the problem. The prior art lack a toilet seat venting device promoting its own cleaning.

A further disadvantage of many such prior art devices is that they have numerous working parts and are, therefore, relatively expensive to manufacture. A related problem is that such complex devices are easily broken.

SUMMARY OF THE INVENTION

The present invention solves the above-described problems in the prior art by providing an improved toilet seat venting apparatus for venting a bathroom of offensive odors, humid air and the like. The present invention furthermore provides a baffle device for preventing drafts and the associated loss of heat or cool air through the apparatus. Additionally, the venting apparatus of the present invention is constructed of a minimum number of durable, relatively inexpensive parts that can be easily cleaned to remove odors and mildew therefrom and to insure that the apparatus does not become a part of the problem.

Generally described, the present invention comprises a pipe fitting, a toilet seat pivotally mounted upon the pipe fitting and including a plurality of intake ports in communication with the pipe fitting, and a suction source operatively connected to the pipe fitting for withdrawing gases through the toilet seat.

Described somewhat more particularly, a first preferred embodiment of an improved toilet seat venting apparatus according to the present invention is adapted for use with a conventional toilet and comprises a pipe fitting secured to the rear rim surface of the toilet. A toilet seat is pivotally mounted upon the pipe fitting, the toilet includes a plurality of intake ports and an inner channel for connecting the intake ports with the pipe fitting. A suction device is operatively connected to the pipe fitting whereby offensive odors, humid air and other gases are withdrawn from a bathroom through the intake ports provided in the toilet seat. A baffle is provided between the suction device and the intake ports. The baffle is operated selectively to prevent against any drafts through the apparatus.

In one form of the invention, the toilet seat defines a groove in its bottom surface and an insert member dimensioned for receipt by this groove is provided therewith. The plurality of intake ports are defined in the insert member. Once inserted into the groove, an integral toilet seat is formed and a passageway is created by the groove and the upper surface of the insert member. In another form of the invention, a plurality of slotted ports are provided that communicate with the suction device so as to exhaust gases to the exterior of the bathroom. In yet another form of the invention, a filter element is provided through which such gases are passed and then redelivered to the bathroom.

Thus, it is an object of the present invention to provide an improved toilet seat venting apparatus.

It is a further object of the present invention to provide an improved toilet seat venting apparatus wherein the apparatus is effective to remove gases from a toilet bowl and an entire bathroom by simply pivoting the toilet seat.

It is a further object of the present invention to provide an improved toilet seat venting apparatus that is constructed of a minimum number of component parts.

It is a further object of the present invention to provide an improved toilet seat venting apparatus that is inexpensive to manufacture.

It is a further object of the present invention to provide an improved toilet seat venting apparatus wherein the interior of all component parts thereof are easily cleaned.

It is a yet further object of the present invention to provide an improved toilet seat venting apparatus that may be used with a conventional toilet.

It is a yet further object of the present invention to provide an improved toilet seat venting apparatus that is filled with a baffle that selectively opens and closes to prevent undesired drafts through the apparatus.

It is a yet further object of the present invention to provide an improved toilet seat venting apparatus that removes odors from a bathroom by passing such gases through a filter element and returns same to the bathroom.

These and other objects, features and advantages of the present invention will become apparent when reading the following specification taken in conjunction with the accompanying drawing.

BRIEF DESCRIPTION OF THE DRAWINGS

FIG. 5 is a cross-section view of the toilet seat and insert member taken along line 5—5 in FIG. 3, showing a vertical position thereof in phantom.

FIG. 6 is a cross-section view of the toilet seat and insert member taken along line 6—6 in FIG. 3.

DETAILED DESCRIPTION

Figure 1:
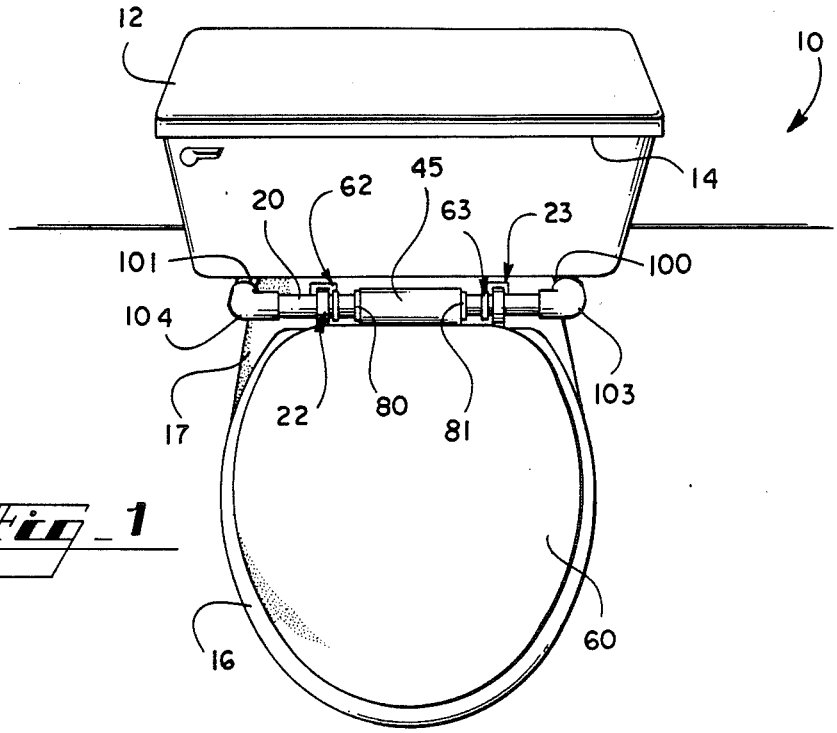
FIG. 1 is a pictorial view of a first embodiment of the improved toilet seat venting apparatus according to the present invention as mounted upon a conventional toilet.

Referring now in more detail to the drawings, in which like numerals indicate like parts throughout the several views, FIG. 1 shows an improved toilet seat venting apparatus generally at 10 according to an embodiment of the present invention. FIG. 1 further shows the preferred embodiment of the present invention fitted to a conventional toilet 12 having a water tank 14 and a toilet bowl 16. The toilet bowl 16 defines a rim 17, the rear portion of which is nearest the base of the water tank 14. The toilet 12 operatively communicates with a plumbing system to dispose of waste by-products in the usual and well-known manner.

Figure 1A:
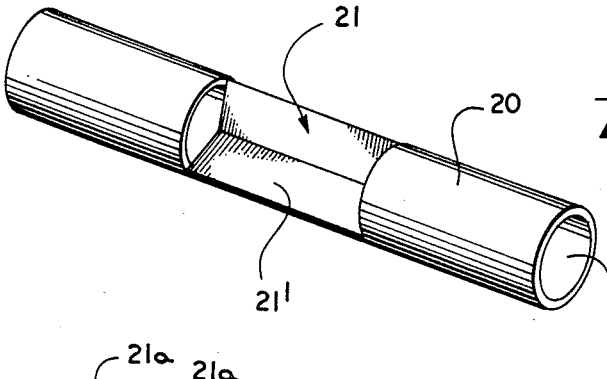
FIG. 1A is a pictorial view of the pipe fitting of the embodiment shown in FIG. 1.

The embodiment of the present invention shown in FIG. 1 provides for a pipe fitting 20 to be fixedly mounted to the rear portion of the toilet bowl 16. As shown in FIG. 1A, the pipe fitting 20 defines a passageway 20'. A center portion of the pipe fitting 20 is cutaway to provide an integrally formed V-shaped deflecting surface 21', the function of which is described in detail hereinbelow. The pipe fitting 20 is preferably made of a plastic material such as polyvinylchloride (PVC), but may be made of any suitably rigid material capable of providing the features of the present invention.

Figure 1B:
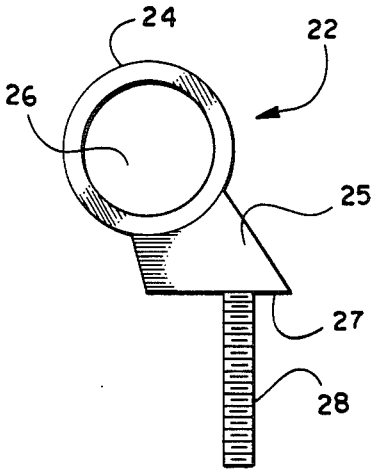
FIG. 1B is a side elevation view of a pipe fitting mounting bolt assembly shown in FIG. 1.

The pipe fitting 20 is mounted upon the rim 17 of the toilet bowl 16 by two bolt assemblies 22 and 23. Because the bolt assemblies 22 and 23 are preferably identical in construction, only one will be described in detail. As shown in FIG. 1B, the preferred pipe fitting mounting bolt assembly 22 generally consists of a ring bracket 24 integrally formed with a supporting body 25. The ring bracket 24 defines an opening 26. The ring bracket 24 and the supporting body 25 are preferably made of polyvinylchloride (PVC), but may be made of any suitably rigid material of sufficient strength to sustain the pipe fitting 20 and components connected thereto as described below in detail. The supporting body 25 defines a bottom surface 27 for engagement to the rear surface of the toilet bowl rim 17. A threaded member 28 is embedded in the supporting body 25 and extends downwardly from the bottom surface 27 so as to be secured within the toilet bowl 16. The threaded member 28 is preferably formed of stainless steel. Of course, other materials may be used. Even so, it is preferable that the selected material be resistant to corrosion.

Figure 2:
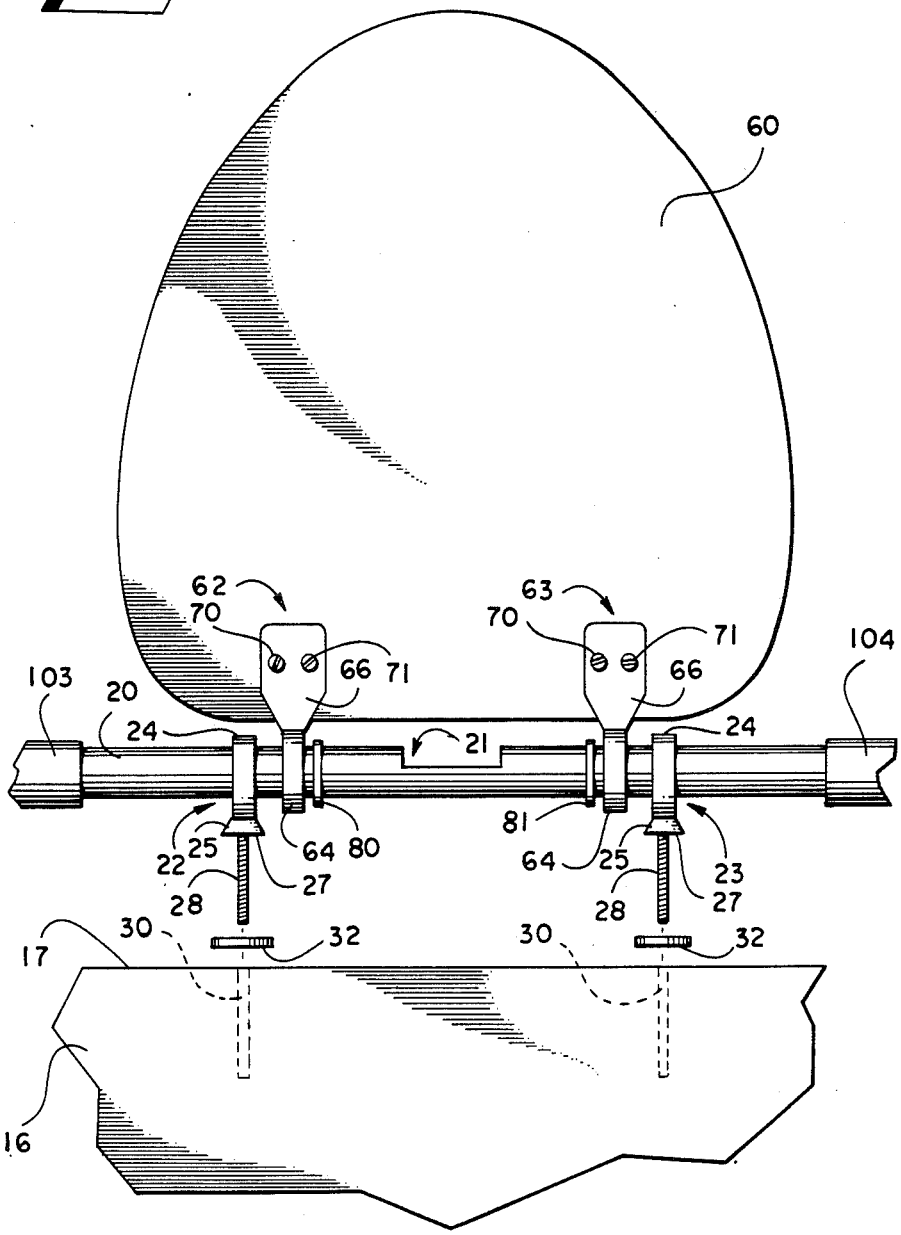
FIG. 2 is a front elevation view of the embodiment shown in FIG. 1 with the toilet seat removed and the pipe fitting exploded from the toilet bowl rim.

As shown in FIG. 2, the preferred embodiment of the present invention provides two mounting bolt assemblies 22 and 23. The threaded members 28 extends downwardly from the supporting bodies 27 to be received by apertures 30 provided in the toilet bowl 16. If desired, decorative washers 32 may be provided to sit between the bottom surfaces 27 of the supporting bodies 25 and the rim 17. In order to mount the pipe fitting 20 upon the toilet bowl 16, the pipe fitting is extended through the opening 26 so as to be carried by the ring brackets 24. Thus, the openings defined by the ring brackets 24 must be of sufficient diameter to receive the pipe fitting 20. It is to be noted that when the mounting bolt assemblies 22 and 23 are screwed into the toilet bowl 16, the pipe fitting 20 is fixedly suspended above the rim 17 of the toilet bowl. Such elevation of the pipe fitting 20 is due to the height of the supporting body 25, the function of which is described below in detail.

A toilet seat 40 is pivotally mounted on the pipe fitting 20. As shown in FIG. 6, the toilet seat 40 has an upper surface 42 and a bottom surface 43. Conventionally, the upper surface 42 is contoured to provide a comfortable seating surface. A groove 44 is provided in the bottom surface 43, the function of which is disclosed in detail hereinbelow. An integrally formed mounting extension 46 is provided at the rear of the toilet seat 40. The mounting extension 46 defines a tubular channel 47 that extends completely therethrough. To mount the toilet seat 40 upon the pipe fitting 20, the pipe fitting 20 is extended through the channel 47 (shown best in FIG. 5). Because the pipe fitting 20 and the channel 47 are preferably round in shape, the toilet seat 40 is pivotable about the pipe fitting. Thus, in keeping with conventional use of a toilet, the present toilet seat 40 may be adjustably positioned.

Figure 9:
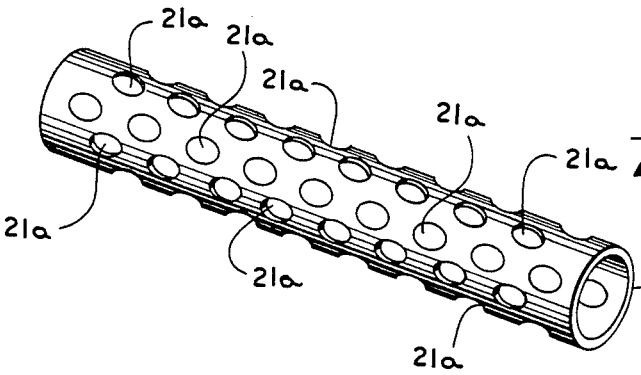
FIG. 9 shows an alternative construction of a pipe fitting as shown in FIG. 8.
Figure 8:
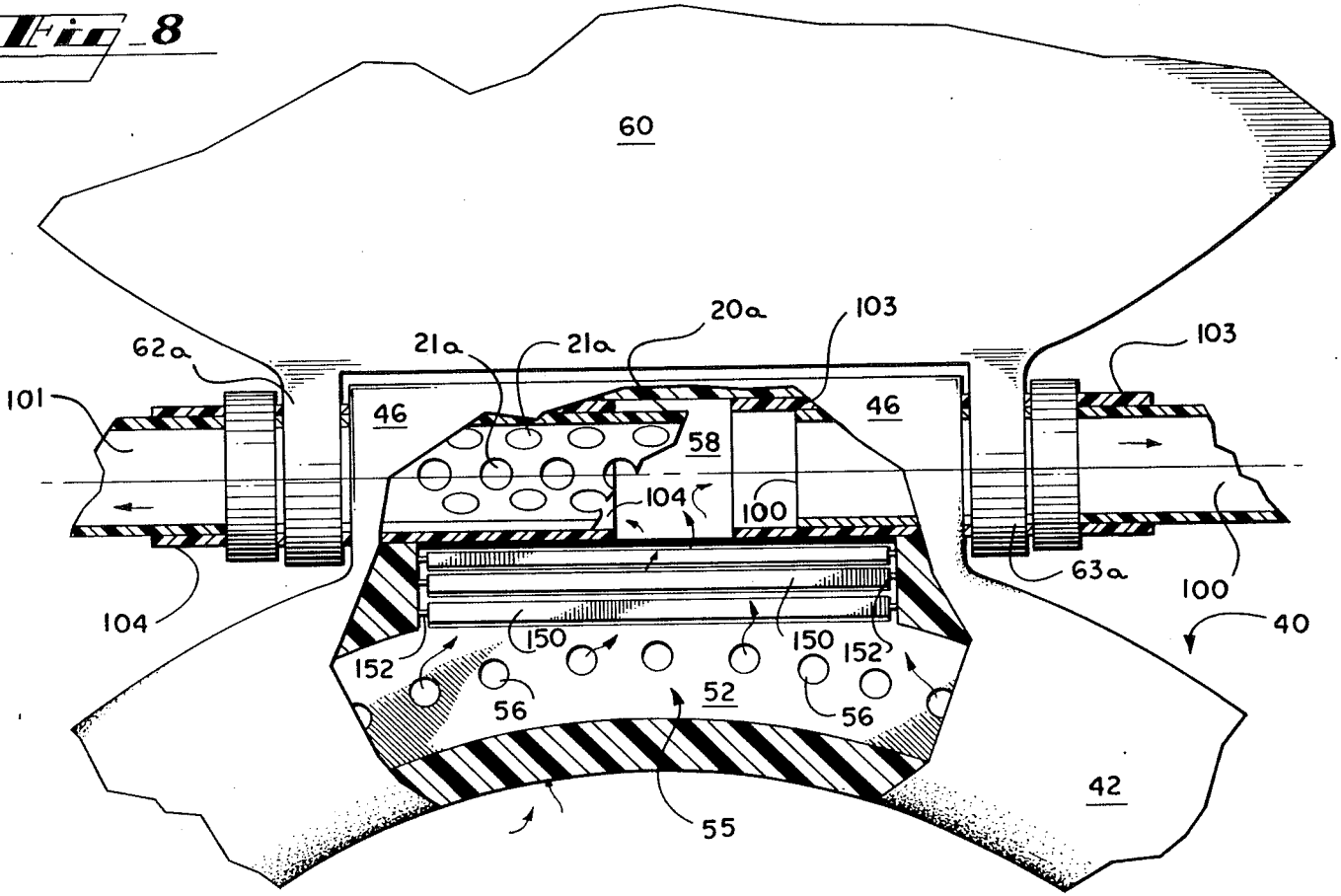
FIG. 8 is a diagrammatic view of an alternative embodiment of the present invention with a portion cut away to show the baffle assembly.

An alternative mounting construction is shown schematically in FIG. 8. As shown therein, the mounting extension 46 of the toilet seat 40 is secured about a pipe 20*a*. The pipe 20*a*, which is shown in isolation in FIG. 9, includes a plurality of apertures 21*a*. This alternative pipe fitting 20*a* also defines a longitudinal passage 20′ which is in communication with a suction device 110 as described hereinbelow. The pipe fitting 20*a* is received by the channel 58 in the mounting extension 46 as also described below. However, the channel 58 is preferably augmented so that air may pass around the entire circumference of the pipe fitting 20*a* so that each of the apertures 21*a* is rendered effective to draw gases therethrough.

The present invention further provides a toilet seat insert member 50 with an upper surface 52 and a flat bottom surface 53. The insert member 50 is ring-like in shape and is preferably made of a resilient or semi-resilient plastic material. The insert member 50 is dimensioned to fit snugly within, but not fill, the groove 44 in the bottom surface 43 of the toilet seat 40. Thus, the insert member 50 is retained within the groove 44. This may be accomplished in any suitable manner. For example, a tongue and groove fit may be provided. Regardless of the means chosen, the thrust of the present invention is for the insert member 50 to be snugly retained yet easily removed from the groove 44.

As noted above, the insert member 50 is not of such dimension as to completely fill the groove 44. While the bottom surface 53 of the insert member 50 is preferably pressed flush against the lowermost side wall portions of the groove 44, the upper surface 52 of the insert member does not contact the ceiling of the groove 44. Instead, the upper surface 52 of the insert member 50 and the ceiling of the groove 44 define a passageway 55 within the inner circumference of the toilet seat 40. The insert member 50 has a plurality of intake ports 56 that communicate with passageway 55. With the mouth of the intake ports 56 being defined in the bottom surface 52 of the insert member 50, the passageway 55 serves as a collection facility for gases drawn through the intake ports 56 as described hereinbelow. Thus, the passageway 55 is preferably of somewhat greater cross-sectional area than that of the intake ports 56.

Additionally, two conventional bumpers 57 and 57′ may be disposed on the bottom surface 52 of the insert member 50 to insure that the toilet seat 40 does not rest on the rim 17 of the toilet bowl 16 when the seat is placed in a horizontal position.

At the rear of the passageway 55 is a channel 58 that communicates directly with the inner channel. The channel 58 is defined in the mounting extension 46 and extends rearwardly towards the pipe fitting 20 or the alternative pipe fitting 20*a*. At its rearwardmost end, the channel 58 defines an opening 58′. As shown best in FIG. 5, the channel 58 cooperates with the cut-out or sectioned portion 21 of the pipe fitting 20. It is to be noted that in the embodiment shown in FIG. 4, the opening 58′ is in communication with the cut-out portion 21 of the pipe fitting 20 regardless of the position of the toilet seat 40. Thus, as further shown in FIG. 5, the channel 58 (and thus, the intake ports 56 and the passageway 55) communicates with the pipe fitting 20 when the toilet seat 40 is in a substantially horizontal position or a substantially vertical position or otherwise.

Turning to the embodiment shown in FIG. 8, the channel 58 is augmented so as to communicate with each of the openings 21*a*. Since the openings 21*a* are distributed about the body of the pipe fitting 20*a*, the channel 58 is maintained in constant communication with the passageway 20′ regardless of the position of the toilet seat 40.

Figure 5A:
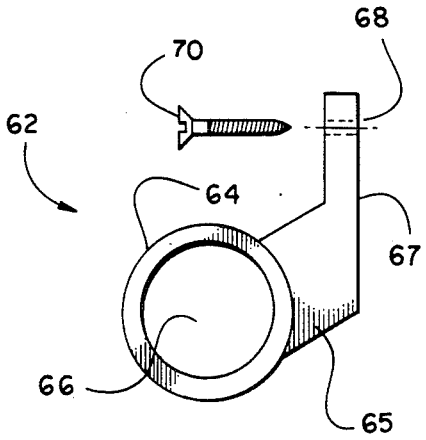
FIG. 5A is a side elevation view of a lid mounting bolt assembly shown in FIG. 1.
Figure 4A:
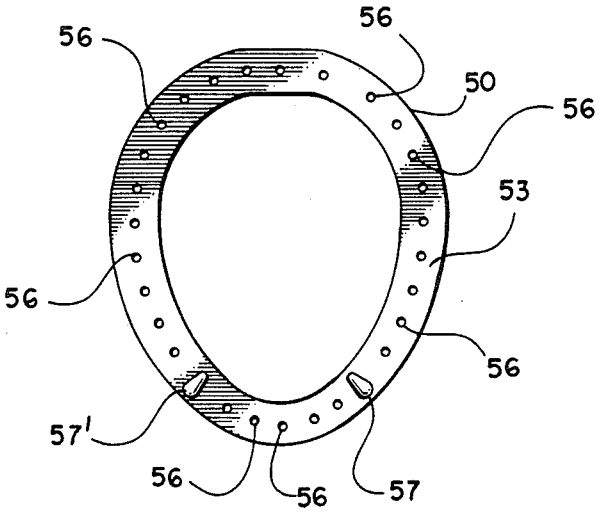
FIG. 4A is a plan view of the undersurface of the insert member shown in FIG. 3.

The present invention further provides for a lid 60 to be pivotally mounted upon the pipe fitting 20 or 20*a*. For the embodiment shown in FIG. 1, this is accomplished by fixedly securing the lid 60 to two pivotable mounting brackets 62 and 63. Since these lid mounting brackets 62 and 63 are identical in construction, only one will be described in detail. As shown in FIG. 5A, the preferred lid mounting bracket 62 generally consists of a ring bracket 64 integrally formed with an L-shaped flanged portion 65. The ring bracket 64 defines an opening 66 and the flanged portion 65 defines an upper surface 67 that engages the underside of the lid 60 as described hereinbelow. The lid mounting bracket 62 is preferably made of polyvinylchloride (PVC), but may be made of any suitably rigid material. Two apertures 68 and 69 are provided at the outer end of the flanged portion 66. Two fastening screws 70 and 71 are provided to extend through the apertures 68 and 69, respectively, and secure the lid 60 to the upper surface 67 of the flanged portion 66. To mount the lid 60 upon the pipe fitting 20, the pipe fitting is extended through the openings 66 defined by the ring brackets 64. The lid 60 and mounting brackets 62 and 63 are therefore carried and supported by the pipe fitting 20. Those skilled in the art will appreciate that the lid 60 is thus free to pivot freely in tandem with the lid mounting brackets 62 and 63 about the pipe fitting 20.

To insure proper spacing of the lid mounting brackets 62 and 63 from the mounting extension 45 of the toilet seat 40, two ring spacers 80 and 81 are provided. These spacers 80 and 81 may be pressed flush against the outer ends of channel 47 defined in the mounting portion 45 of the toilet seat 40 so as to prevent any escape of gases from the toilet seat pipe fitting communication.

In an alternative form of the invention as shown in FIG. 8, the lid 60 may be formed integrally with mounting extensions 62*a* and 63*a* so as to be fitted directly about the alternative pipe fitting 201.

The present invention further provides two duct fittings 100 and 101 coupled to the outer ends of the pipe fitting 20 by two elbow fittings 103 and 104, respectively. Preferably, these elbow fittings 103 and 104 telescopically receive the pipe fitting 20 or the alternative pipe fitting 20*a*. Thus, the pipe fitting 20 or 20*a* may be secured to any sized toilet because the telescopic feature of the elbow fittings 103 and 104 facilitates adjustment thereof as needed. In addition, it will be appreciated that by covering a greater portion of the opening 21 in the pipe fitting 20 or a greater number of openings 21*a* in the alternative pipe fitting 20*a*, the amount of air passing therethrough will be decreased. Thus, it is to be understood that the amount of air passing through the apparatus 10 can be varied as desired.

Figure 3:
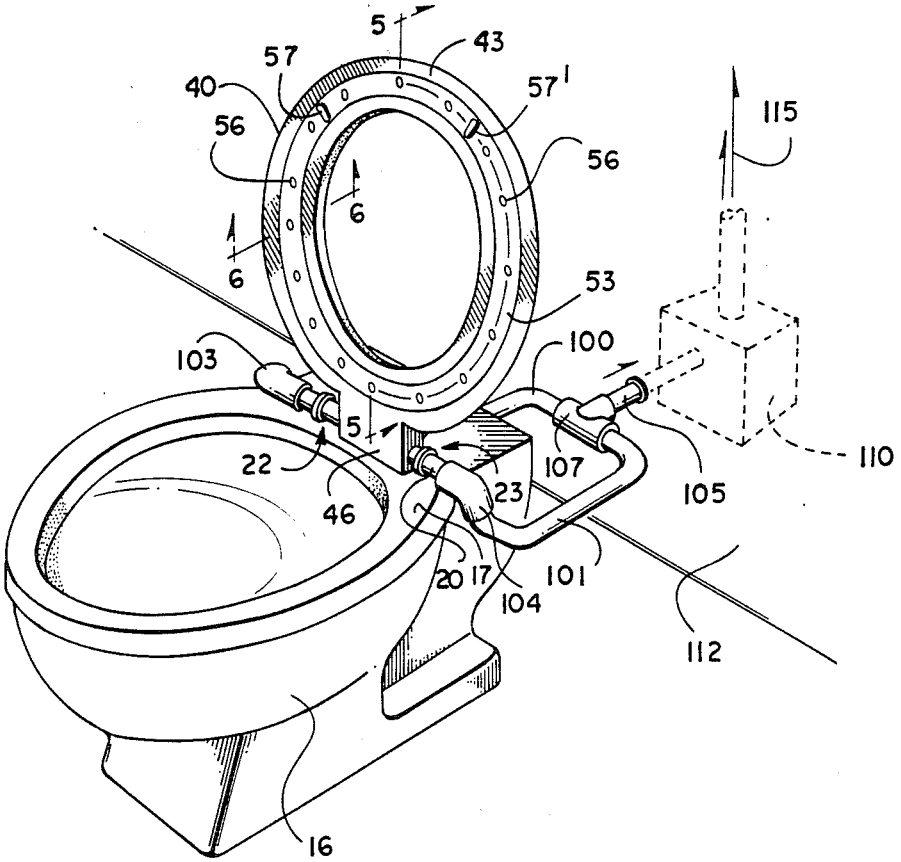
FIG. 3 is a pictorial view of the embodiment shown in FIG. 1 with the lid removed.

The duct fittings 100 and 101 are, in turn, coupled to a duct fitting 105 by a T-fitting 107. Duct fitting 105 is connected to a suction device, shown diagrammatically at 110 in the drawing. Such connection is well known in the art, and hence, need not be disclosed further herein. It is to be noted that each such connection provides an airtight seal thereof so as to ensure that maximum suction is achieved by the suction device 110. A preferred suction device 110 is a suction fan, but any other suitable device may be used. As shown in FIG. 3, it is preferable that the suction device 110 be placed behind a wall 112 in order to muffle any noise associated therewith and maintain the aesthetically pleasing conditions of the bathroom. However, such placement of the suction device 110 is not critical to the invention since the device may be disposed on the floor behind the toilet. Additionally, an exhaust duct (shown diagrammatically as line 115 in the drawing) may be provided. Preferably, the exhaust duct 115 is connected to the suction device 110 so as to direct any collected gases from the bathroom to the exterior of the building.

Figure 4:
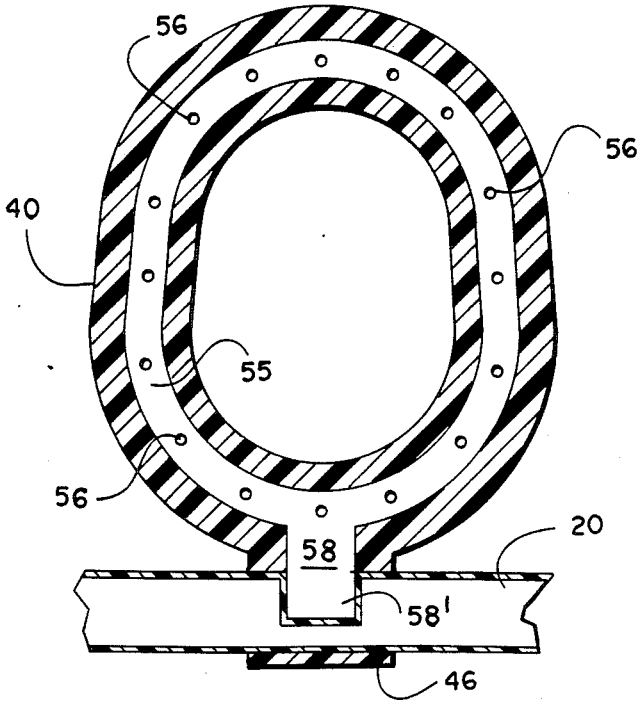
FIG. 4 is a cross-section view of the toilet seat and the pipe fitting of FIG. 1 showing the communication therebetween.

It is to be understood that each disclosed embodiment of the present invention includes a baffle 150. Shown best in FIG. 8, the baffle 150 is pivotally mounted on a pin 152 that extends lengthwise through the baffle. The pin 152 is fixedly received in the inner walls of the seat 40 that define the channel 58 in the mounting extension 46 in any conventional manner. The baffle 150 extends lengthwise across the channel 58 and is preferably mounted so that when no air is being withdrawn through the channel 58, it blocks the channel and prevents any communication of the intake ports 56 with the channel and the suction device. However, once the suction device 110 is activated, the baffle 150 is pivotally deflected so that the channel 58 is placed in communication with the suction device and gases can be withdrawn from the bathroom. The positioning of the baffle 150 with the embodiment shown in FIG. 4 is shown in FIG. 5.

In use of the present invention, the insert member 50 is snapped into place within the groove 44 in the toilet seat 40. The suction device 110 is then activated in a conventional manner while the toilet seat 40 is resting on the rim 17 of the toilet bowl 16. The effect of such operation is to draw offensive odors located in the vicinity of the toilet bowl 16 to the intake ports 56. These odors are then drawn through the intake ports 56, through the passageway 55, and through the channel 58 defined in the mounting portion 45 of the toilet seat 40. The odors then engage the deflecting surface 21' and are directed into the passageway 20' defined by the pipe fitting 20. The suction device 110 operates further to draw these odors from the pipe fitting 20 into the duct fitting 100 and 101, and eventually to the suction device 110.

The toilet seat 40 may then be pivoted into a substantially vertical position as shown in FIGS. 3 and 5. As a result of the communication between the sectioned portion 21 of the pipe fitting 20, the passageway 55 and channel 58, the intake ports 56 remain in communication with the opening 20' of the pipe fitting. Thus, the intake ports 56 may also be directed towards the bathroom proper so as to effectively withdraw not only offensive odors, but humid air and other gases that the present invention therefore improves on the prior art in that it effectively removes gases from both a toilet bowl and a bathroom through utilization of a minimum number of component parts.

Figure 7:
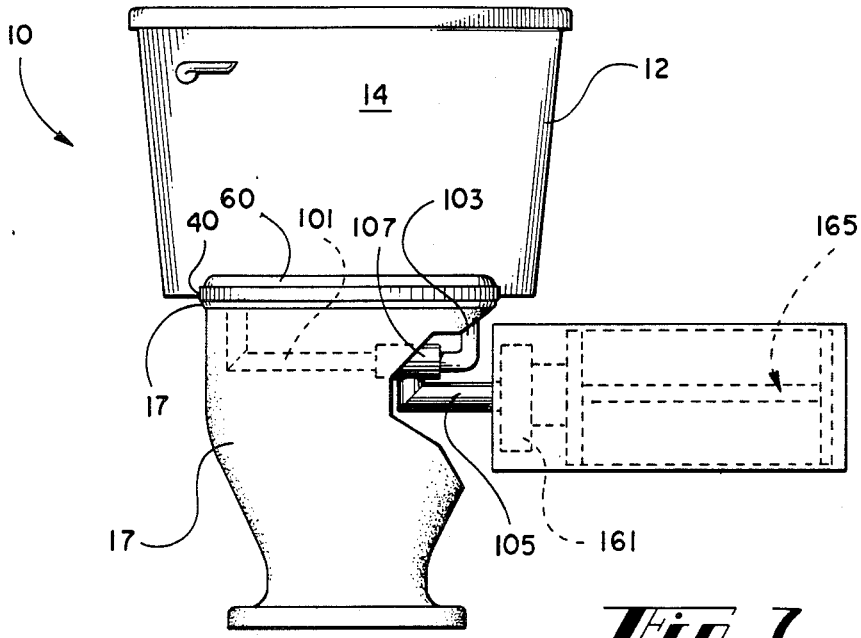
FIG. 7 is a pictorial schematic view of a second embodiment of the present invention employing a filter element.

Even so, yet another form of the invention is shown in FIG. 7. It will be appreciated that the duct fitting 105 is connected to the duct fittings 101 and 103 as described hereinabove. In addition, while not shown with particularity in FIG. 7, the toilet seat 40 has been constructed in accordance with the teaching of the present invention. However, instead of the toilet seat being in communication with the suction device 110 as described, a suction device 161 has been provided. The suction device 161 comprises a conventional fan and motor (not shown) that act in concert to draw gasses through the toilet seat 50. However, instead of exhausting such gases to the exterior of the bathroom, the gases are delivered to a conventional filter element, shown generally at 165. The filter 165, which may be a conventional charcoal or electronic filter, may be conveniently housed with the fan and motor such device 161. Once the filter has removed all the odor from gases being delivered thereto, the gases may be passed back into the bathroom.

It will be appreciated that the present apparatus may be thoroughly cleaned without significant effort. The insert member 50 and intake ports 56 are easily accessed by removing the insert member 50 from the groove 44. With the insert member 50 so removed, the groove 44, channel 58 and baffle 150 may also be cleaned. The removal of the elbow fittings 103 and 104 at the ends of the pipe fitting 20 permits access to the interior thereof for cleaning. Thus, the present invention not only provides a minimum number of parts, but further provides for those parts to be easily assembled and cleaned.

While the present invention has been described in detail with particular reference to the preferred embodiments thereof, it will be understood that variations and modifications can be effected within the spirit and scope fo the present invention as described hereinbefore and as defined in the appended claims.

I claim:

1. An improved toilet seat venting apparatus for use with a conventional toilet having a rim, the apparatus comprising:

a pipe fitting having two ends and being fixedly secured to the rim of a toilet, a portion of said pipe fitting being sectioned to provide a deflecting surface;

a toilet seat pivotally mounted upon said pipe fitting, said toilet seat including an inner channel disposed within said toilet seat so as to communicate with said sectioned portion of said pipe fitting regardless of the position of said toilet seat, a baffle disposed within said inner channel for selective obstruction thereof, and a groove defined in the bottom surface of said toilet seat that communicates with said inner channel;

an insert member dimensioned for receipt by said groove in the bottom surface of said toilet seat so as to form a passageway within said toilet seat that communicates with said inner channel, said insert member defining a plurality of intake ports that communicate with said passageway; and a pair of receiving fittings that extend about and depend from the two ends of said pipe fitting respectively, said receiving fittings being telescopic with said pipe fitting for variable obstruction of said sectioned portion thereof; and means for suctioning operatively connected to said pipe fitting via said receiving fittings for drawing air from the area of said toilet seat through said pipe fitting, whereby, upon activation of said means for suctioning said baffle is withdrawn from obstruction of said inner channel and gases are drawn through said intake ports, said passageway, said means regardless of the position of the toilet seat and the flow of gases therethrough may be varied by adjustment of said telescopic receiving fittings.

2. An improved toilet seat venting apparatus for use with a conventional toilet having a rim, the aparatus comprising:

a pipe fitting having two ends and being fixedly secured to the rim of a toilet, said pipe fitting defining a plurality of openings for withdrawal of gases therethrough;

a toilet seat pivotally mounted upon said pipe fitting, said toilet seat including an inner channel disposed within said toilet seat so as to communicate with said plurality of openings of said pipe fitting regardless of the position of said toilet seat, a baffle disposed within said inner channel for selective obstruction thereof, and a groove defined in the bottom surface of said toilet seat that communicates with said inner channel;

an insert member dimensioned for receipt by said groove in the bottom surface of said toilet seat so as to form a passageway within said toilet seat that communicates with said inner channel, said insert member defining a plurality of intake ports that communicate with said passageway; and a pair of receiving fittings that extend about and depend from the two ends of said pipe fitting respectively, said receiving fittings being telescopic with said pipe fitting for variable obstruction of said plurality of openings thereof; and means for suctioning operatively connected to said pipe fitting via said receiving fittings for drawing air from the area of said toilet seat through said pipe fittings, whereby, upon activation of said means for suctioning, said baffle is withdrawn from obstruction of said inner channel and gases are drawn through said intake ports, said passageway, said means regardless of the position of the toilet seat and the flow of gases therethrough may be varied by adjustment of said telescopic receiving fittings.

* * * * *